US011081834B2

(12) United States Patent
Gu

(10) Patent No.: US 11,081,834 B2
(45) Date of Patent: Aug. 3, 2021

(54) WATERPROOF USB SOCKET AND MANUFACTURING METHOD OF THE SAME

(71) Applicant: SHENZHEN EVERWIN PRECISION TECHNOLOGY CO LTD, Guangdong (CN)

(72) Inventor: Yuanwen Gu, Guangdong (CN)

(73) Assignee: SHENZHEN EVERWIN PRECISION TECHNOLOGY CO LTD, Guangdong (CN)

( * ) Notice: Subject to any disclaimer, the term of this patent is extended or adjusted under 35 U.S.C. 154(b) by 0 days.

(21) Appl. No.: 16/770,702

(22) PCT Filed: Jun. 26, 2019

(86) PCT No.: PCT/CN2019/092941
§ 371 (c)(1),
(2) Date: Jun. 8, 2020

(87) PCT Pub. No.: WO2020/001461
PCT Pub. Date: Jan. 2, 2020

(65) Prior Publication Data

US 2021/0111509 A1 Apr. 15, 2021

(30) Foreign Application Priority Data

Jun. 28, 2018 (CN) ..... 201810694873.5

(51) Int. Cl.
*H01R 13/52* (2006.01)
*H01R 13/504* (2006.01)
(Continued)

(52) U.S. Cl.
CPC ..... *H01R 13/5219* (2013.01); *H01R 13/504* (2013.01); *H01R 13/6585* (2013.01);
(Continued)

(58) Field of Classification Search
CPC ..... H01R 13/5202; H01R 13/502; H01R 13/6581; H01R 43/005; H01R 43/24; H01R 13/5219; H01R 13/504; H01R 13/52
See application file for complete search history.

(56) References Cited

U.S. PATENT DOCUMENTS

2015/0229072 A1 8/2015 Fallon et al.
2016/0294105 A1* 10/2016 Zhao ..... H01R 12/724

FOREIGN PATENT DOCUMENTS

CN 105048249 A 11/2015
CN 107069309 A 8/2017
(Continued)

OTHER PUBLICATIONS

International Search Report and Written Opinion in International Application No. PCT/CN2019/092941 (dated Sep. 10, 2019).

*Primary Examiner* — Abdullah A Riyami
*Assistant Examiner* — Justin M Kratt
(74) *Attorney, Agent, or Firm* — Leydig, Voit & Mayer, Ltd.

(57) ABSTRACT

A waterproof USB socket includes a connector, a metal housing, a waterproof glue filled in a tail portion of the connector, and a waterproof ring. The connector includes a metal intermediate plate, first and second terminal groups, and an insulating body. The insulating body includes a base portion, a step portion formed by extending forward from the base portion, and a docking portion formed by extending forward from the step portion. The metal housing includes an inner metal shell having a seamless outer wall. A stopping member is integrally formed on the base portion of the insulating body, and includes a spot-welding platform and a stopping portion; and the spot-welding platform of the stopping member is in contact with the inner metal shell and the two are fixed into one piece by means of spot-welding.
(Continued)

The present disclosure further provides a manufacturing method of the waterproof USB socket.

20 Claims, 7 Drawing Sheets

(51) Int. Cl.

| | |
|---|---|
| ***H01R 13/6585*** | (2011.01) |
| ***H01R 43/24*** | (2006.01) |
| *H01R 43/00* | (2006.01) |
| *H01R 13/502* | (2006.01) |
| *H01R 13/6581* | (2011.01) |

(52) U.S. Cl.
CPC ..... *H01R 43/24* (2013.01); *H01R 13/502* (2013.01); *H01R 13/52* (2013.01); *H01R 13/5202* (2013.01); *H01R 13/6581* (2013.01); *H01R 43/005* (2013.01)

(56) References Cited

FOREIGN PATENT DOCUMENTS

| | | | |
|---|---|---|---|
| CN | 206742538 | U | 12/2017 |
| CN | 108963511 | A | 12/2018 |
| CN | 108963555 | A | 12/2018 |
| CN | 208299119 | U | 12/2018 |

* cited by examiner

WATERPROOF USB SOCKET AND MANUFACTURING METHOD OF THE SAME

CROSS-REFERENCE TO RELATED APPLICATIONS

This patent application is a U.S. national phase of International Application No. PCT/CN2019/092941, filed on Jun. 26, 2019, which claims priority to Chinese Patent Application No. 201810694873.5, filed on Jun. 28, 2018. The disclosures of the aforementioned applications are hereby incorporated by reference in their entireties.

TECHNICAL FIELD

Embodiments of the present disclosure relate to the technical field of connectors, and in particular, to a waterproof Universal Serial Bus (USB) socket and a manufacturing method thereof.

BACKGROUND

A USB socket generally includes a connector and a metal housing sleeved on a periphery of the connector. The metal housing is provided with a receiving cavity for inserting a plug. In order to prevent the socket from being damaged by excessive insertion of the plug, the metal housing is generally stamped to form a plurality of stopping members for resisting a metal housing of the plug. In this way, the metal housing of the socket has a penetrating hole structure and cannot be waterproof.

SUMMARY

In view of this, the present disclosure provides a waterproof USB socket with good waterproof performance, and a manufacturing method thereof.

In order to solve the technical problem described above, the present disclosure provides a waterproof USB socket, including: a connector, a metal housing sleeved on a periphery of the connector, a waterproof glue filled in a tail portion of the connector, and a waterproof ring sleeved on a periphery of the metal housing. The connector includes a metal intermediate plate, first and second terminal groups respectively provided at upper and lower sides of the metal intermediate plate, and an insulating body for integrating the metal intermediate plate and the first and second terminal groups into one piece. The insulating body includes a base portion, a step portion formed by extending forward from the base portion, and a docking portion formed by extending forward from the step portion. The metal housing includes an inner metal shell having a seamless outer wall. A stopping member is integrally formed on the base portion of the insulating body, and the stopping member includes a spot-welding platform and a stopping portion formed at front end of the base portion by bending and then extending downward from the spot-welding platform; and the spot-welding platform of the stopping member is in contact with the inner metal shell and the two are fixed into one piece by means of spot-welding.

In an embodiment, the insulating body comprises a first plastic body, a second plastic body and a third plastic body; the first plastic body integrates the first terminal group, the metal intermediate plate and one stopping member into one piece; the second plastic body integrates the second terminal group and another stopping member into one piece; and the third plastic body integrates the first plastic body and the second plastic body into one piece.

In an embodiment, the first plastic body and the second plastic body are each provided with a receiving groove at a position corresponding to the base portion, and two lateral sides of the receiving groove are removed to form removed portions; and the receiving groove extends from the position corresponding to the base portion to the front end of the base portion.

In an embodiment, the stopping member further comprises first embedded portions formed by extending downward from two lateral sides of the spot-welding platform and then bending in parallel to the spot-welding platform, and each of the first embedded portions comprises a vertical portion and a horizontal portion.

In an embodiment, a third embedded portion is formed by extending downward from a longitudinal rear end of the spot-welding platform; and second embedded portions are formed by extending from two lateral sides of the stopping portion towards the spot-welding platform.

In an embodiment, the stopping member is integrally formed in the receiving groove, and each of the second embedded portions and the third embedded portion is embedded in the first plastic body or the second plastic body; the horizontal portion at a bottom of each of the first embedded portions is embedded in the first plastic body or the second plastic body, and the vertical portion of each of the first embedded portions is exposed at a position of the removed portions.

In an embodiment, when the first plastic body and the second plastic body are stacked and then insert molding again, the removed portions are fully filled by the third plastic body, and the vertical portion is completely embedded in the third plastic body.

In an embodiment, the metal housing further comprises a first metal shell and a second metal shell that sandwich the inner metal shell from an upper side and lower side, and the first metal shell and the second metal shell are fixed to the inner metal shell by means of spot-welding.

In an embodiment, the first metal shell and the second metal shell are each provided with ear portions extending at lateral sides, and a fixing hole is opened at a middle position of each of the ear portions.

In order to solve the technical problem described above, the present disclosure further provides a manufacturing method of the waterproof USB socket, including: Step S01: performing a first in-mold injection molding on the first terminal group, the metal intermediate plate and one stopping member that are prepared and punched, to form the first plastic body; and performing a second in-mold injection molding on the second terminal group and the other stopping member that are prepared and punched, to form the second plastic body; Step S02: performing a third in-mold injection molding on the first plastic body and the second plastic body that are stacked, to form the third plastic body and complete a manufacturing of the connector; Step S03: inserting the connector into the inner metal shell, and welding the inner metal shell and the spot-welding platform of the stopping member into one piece by means of spot-welding; and Step S04: sandwiching the inner metal shell by outer metal shells, and spot-welding the inner metal shell and the outer metal shells into one piece.

In order to solve the technical problem described above, the present disclosure further provides a waterproof USB socket, including a connector, a metal housing sleeved on a periphery of the connector, a waterproof glue filled in a tail portion of the connector, and a waterproof ring sleeved on a periphery of the metal housing. The connector comprises a metal intermediate plate, a first terminal group and a second terminal group respectively provided at an upper side and a lower side of the metal intermediate plate, and an insulating body integrating the metal intermediate plate, the first terminal group and the second terminal group into one piece. The insulating body comprises a base portion, a step portion formed by extending forward from the base portion, and a docking portion formed by extending forward from the step portion. The metal housing comprises an inner metal shell having a seamless outer wall. A stopping member is inserted in the base portion of the insulating body, and the stopping member comprises a spot-welding platform, and a stopping portion formed at front end of the base portion by bending and then extending downward from the spot-welding platform; and the spot-welding platform of the stopping member and the inner metal shell are in contact and fixed into one piece by means of spot-welding.

In an embodiment, the insulating body comprises a first plastic body, a second plastic body and a third plastic body; the first plastic body integrates the first terminal group and the metal intermediate plate into one piece; and the second plastic body integrates the second terminal group into one piece.

In an embodiment, the first plastic body and the second plastic body are each provided with a receiving platform at a position corresponding to the base portion, and two lateral sides of the receiving platform are removed to form removed portions; each of the removed portions is provided with an engaging hole; the stopping member further comprises first embedded portions formed by extending downward from two lateral sides of the spot-welding platform and then bending in parallel to the spot-welding platform, and each of the first embedded portions comprises a vertical portion, a horizontal portion, and a hook inserted in the engaging hole.

In an embodiment, a front end of each of the removed portions is provided with a concession space, and second embedded portions are formed by extending from two lateral sides of the stopping portion while being bent towards the spot-welding platform, and are received in the concession space; and each of the second embedded portions further comprises an engaging portion formed by extending from an end of the second embedded portion while being bent vertically.

In an embodiment, a rear end edge of the receiving platform is provided with an engaging slot, and a front end of the receiving platform is provided with a positioning block; a third embedded portion is formed by extending from a longitudinal rear end of the spot-welding platform while being bent downward and is inserted into the engaging slot; and the stopping portion of the stopping member is further provided with a positioning notch matching the positioning block.

In an embodiment, the stopping member is inserted in the receiving platform, the hook is inserted in the engaging hole, and the vertical portion and the horizontal portion are exposed at a position of the removed portions.

In an embodiment, the third plastic body integrates the first plastic body, the second plastic body and two stopping members into one piece; the third plastic body fully fills the removed portions and the concession space in such a manner that the first embedded portions and the second embedded portions of the stopping member are completely embedded and fixed in the third plastic body.

In an embodiment, the metal housing further comprises a first metal shell and a second metal shell that sandwich the inner metal shell, and the first metal shell and the second metal shell are fixed to the inner metal shell by means of spot-welding.

In an embodiment, the first metal shell and the second metal shell are each provided with ear portions extending at lateral sides, and a fixing hole is opened at a middle position of each of the ear portions.

In order to solve the technical problem described above, the present disclosure further provides a manufacturing method of the waterproof USB socket, including: Step S01: performing a first in-mold injection molding on the first terminal group and the metal intermediate plate that are prepared and punched, to form the first plastic body; and performing a second in-mold injection molding on the second terminal group that is prepared and punched, to form the second plastic body; Step S02: inserting the stopping member that is prepared and punched into the receiving platform of the first plastic body and the second plastic body, respectively; Step S03: performing a third in-mold injection molding on the first plastic body and the second plastic body that are stacked, to form the third plastic body, wherein the third plastic body fully fills the removed portions and the concession space of the first plastic body and the second plastic body to tightly fix the stopping member and the connector into one piece; Step S04: inserting the connector into the inner metal shell, and welding the inner metal shell and the spot-welding platform of the stopping member into one piece by means of spot-welding; and Step S05: sandwiching the inner metal shell by outer metal shells, and spot-welding the inner metal shell and the outer metal shells into one piece.

In the present disclosure, by providing the stopping member on the base portion of the insulating body, the problem of over insertion of the plug is solved, such that the inner metal shell is not required to be punched at a corresponding position to form a stopping member, as in the related art, which causes a seam or hole formed in the inner metal shell and thus the inner metal shell cannot be waterproof.

BRIEF DESCRIPTION OF DRAWINGS

The accompanying drawings described herein are intended to facilitate the understanding of the present disclosure, and belong to a part of the present disclosure. The illustrative embodiments of the present disclosure and corresponding description thereof aim to explain the present disclosure, instead of constituting an undue limitation of the present disclosure.

DESCRIPTION OF EMBODIMENTS

Figure 1:
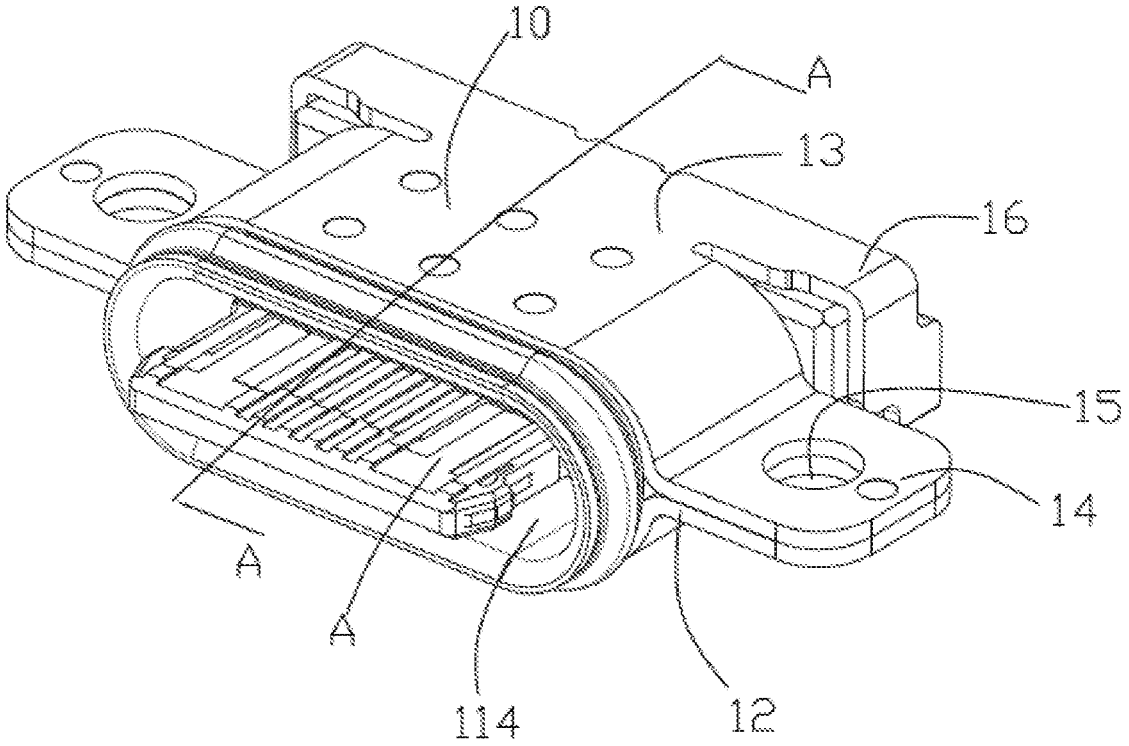
FIG. 1 is a perspective assembly view of a waterproof USB socket according to Embodiment 1 of the present disclosure.
Figure 2:
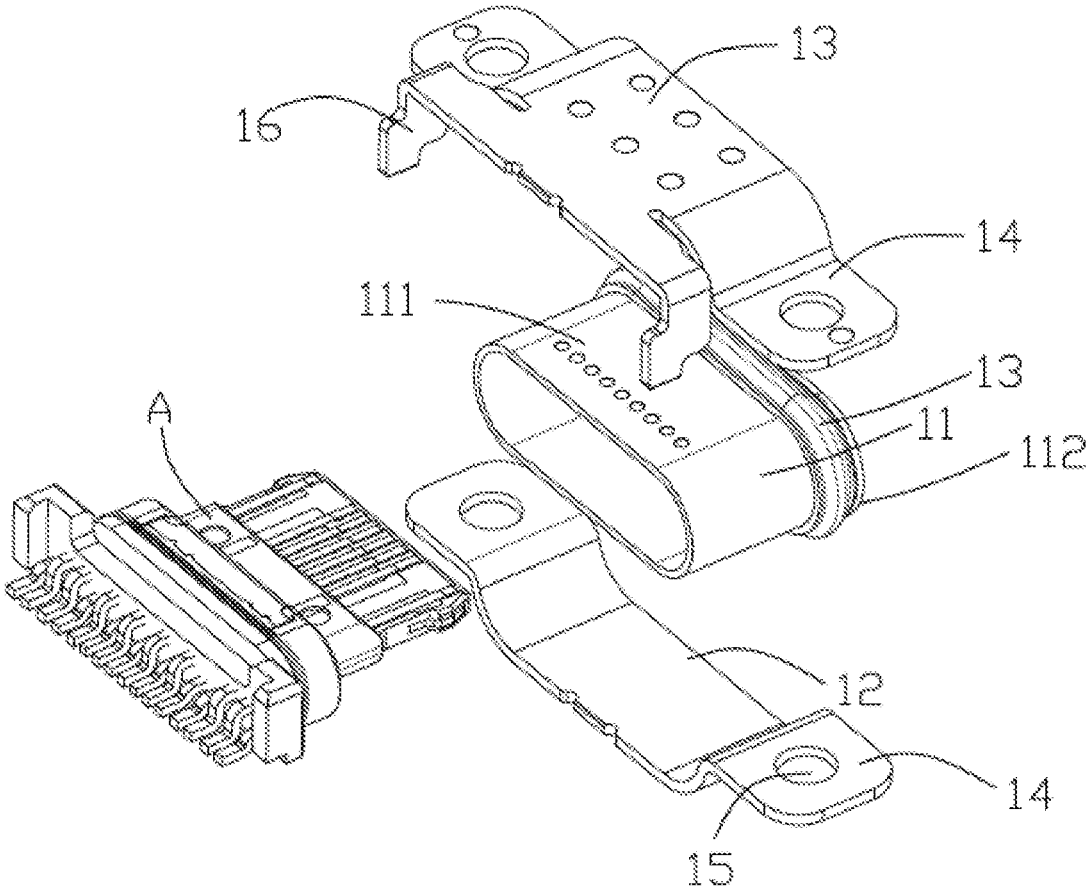
FIG. 2 is a perspective exploded view of the waterproof USB socket according to Embodiment 1 of the present disclosure.
Figure 3:
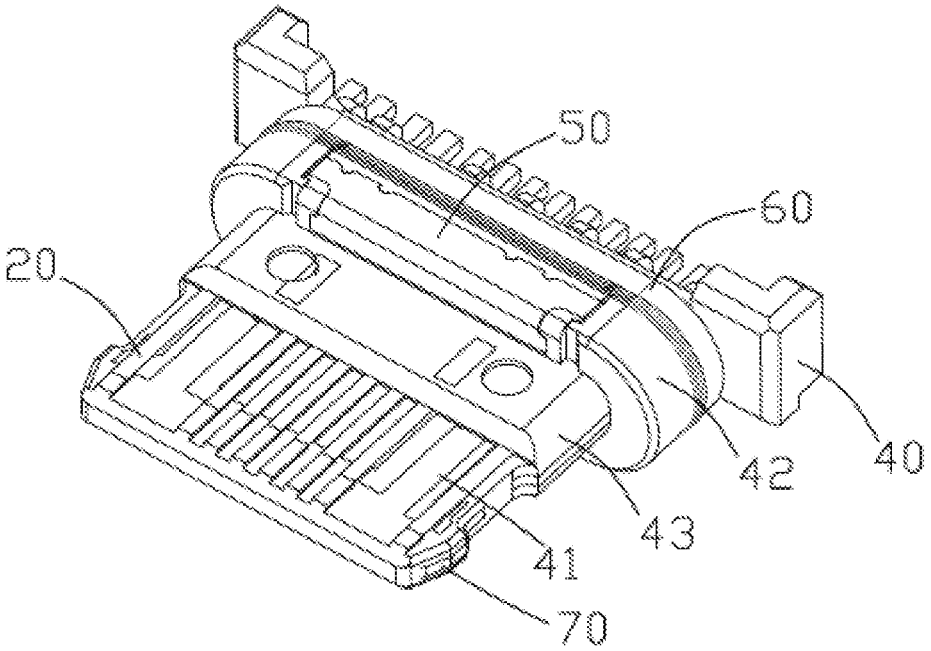
FIG. 3 is a perspective view of a connector of the waterproof USB socket according to Embodiment 1 of the present disclosure.

In order to clarify purposes, technical solutions, and advantages of the present disclosure, the technical solutions of the present disclosure will be clearly and fully described with reference to specific embodiments and accompanying drawings of the present disclosure. It is apparent that the described embodiments are only a part of the embodiments of the present disclosure, rather than all of them. All other embodiments, which are obtained by those skilled in the art based on the disclosed embodiments of the present disclosure without departing from the inventive scope, shall fall within the scope of the present disclosure.

Embodiment 1

Referring to FIG. 1 to FIG. 9, a waterproof USB socket according to the present disclosure includes: a connector A, a metal housing 10 sleeved on a periphery of the connector A, a waterproof glue filled in a tail portion of the connector A, and a waterproof ring 113 sleeved on a front end of the metal housing 10.

The connector A includes terminal groups 20, 30, a metal intermediate plate 70, and an insulating body 40 that integrates the terminal groups 20, 30 and the metal intermediate plate 70 into one piece. The insulating body 40 includes a base portion 42, a step portion 43 formed by extending forward from the base portion 42, and a docking portion 41 formed by extending forward from the step portion 43. The terminal groups 20, 30 are partially exposed at an upper and/or a lower surface of the docking portion 41 to be electrically contacted to a mating connector.

The metal housing 10 includes an inner metal shell 11 sleeved on a periphery of the insulating body 40, a first metal shell 12 and a second metal shell 13 that sandwich the inner metal shell 11. The inner metal shell 11 includes a peripheral wall 111 from an upper side and a lower side thereof, a plug-in cavity 114 enclosed by the peripheral wall 111, a stopping portion 112 formed by extending forward from a front end of the peripheral wall 111, and a waterproof ring sleeved on a periphery of the peripheral wall 111 and limited to an inner side of the stopping portion 112.

The first and second metal shells 12, 13 sandwich the inner metal shell 11 from the upper and lower sides thereof and are fixed to the inner metal shell 11 by surface spot-welding. The first and second metal shells 12, 13 are each provided ear portions 14 extending at two lateral sides, and a fixing hole 15 is opened at a middle position of each ear portion 14. A rear end of the second metal shell 13 further extends to form a protection portion 16 for protecting weld feet of the terminal groups 20 and 30.

A periphery of the base portion 42 of the insulating body 40 is attached to an inner surface of the inner metal shell 11. The connector A further includes stopping members 50 disposed at an upper surface and a lower surface of the base portion 42 and spot-welded to the inner metal shell 11 into one piece.

The terminal groups 20, 30 include a first terminal group 20 and a second terminal group 30 located two sides of the metal intermediate plate 70.

The insulating body 40 includes a first plastic body 44, a second plastic body 45 and a third plastic body 46. The first plastic body 44 integrates the first terminal group 20, the metal intermediate plate 70 and one stopping member 50 into one piece. The second plastic body 45 integrates the second terminal group 30 and another stopping member 50 into one piece. The third plastic body 46 integrates the first plastic body 44 and the second plastic body 45 into one piece.

Figure 5:
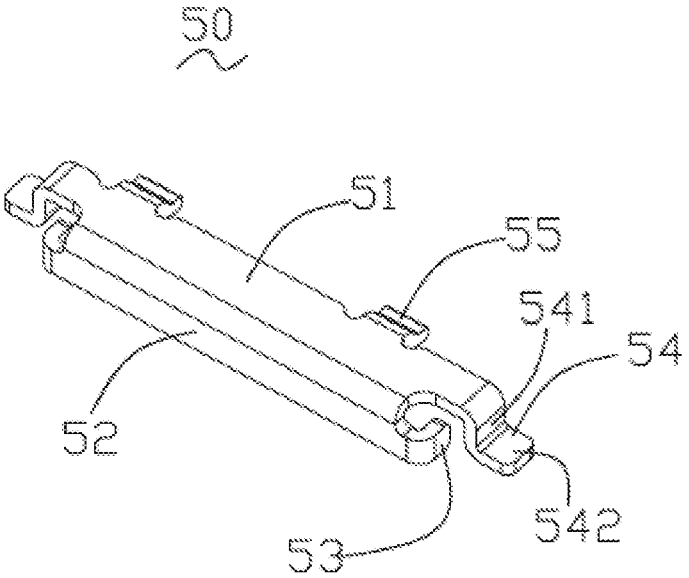
FIG. 5 is a perspective view of a stopping member of the waterproof USB socket according to Embodiment 1 of the present disclosure.

Referring to FIG. 5, the stopping member 50 includes a spot-welding platform 51 and a stopping portion 52 formed by extending from the spot-welding platform 51 while being bent. First embedded portions 54 are formed by extending downward from two lateral sides of the spot-welding platform 51 and then bending in parallel to the spot-welding platform. In this way, each first embedded portion 54 has a vertical portion 541 and a horizontal portion 542. A third embedded portion 55 is formed by extending from a longitudinal end of the spot-welding platform 51. Second embedded portions 53 are formed by extending from two lateral sides of the stopping portion 52 towards the spot-welding platform 51.

Figure 6:
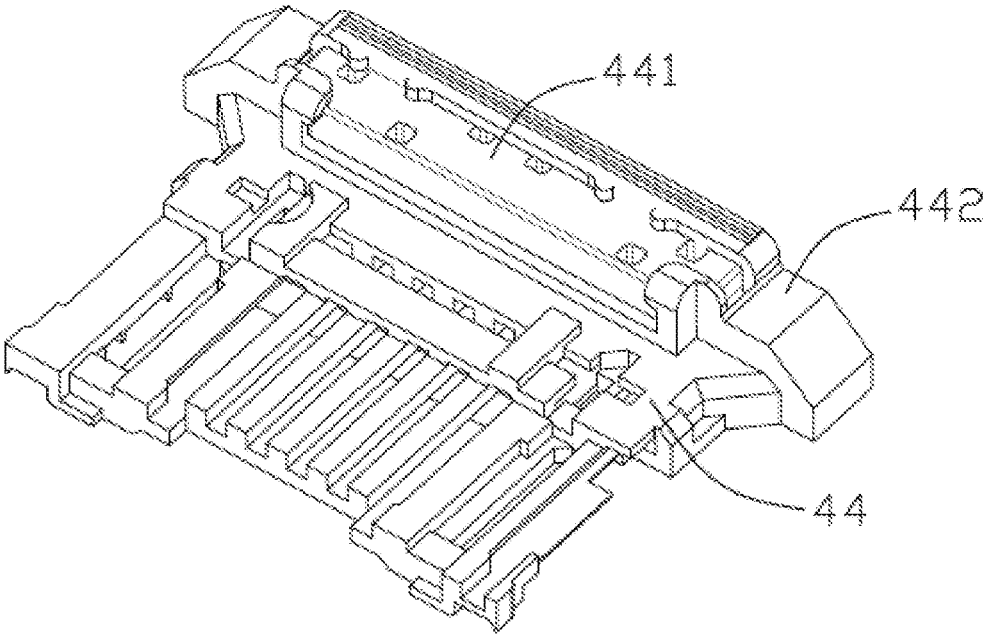
FIG. 6 is a perspective view of a first plastic body of the waterproof USB socket according to Embodiment 1 of the present disclosure.
Figure 7:
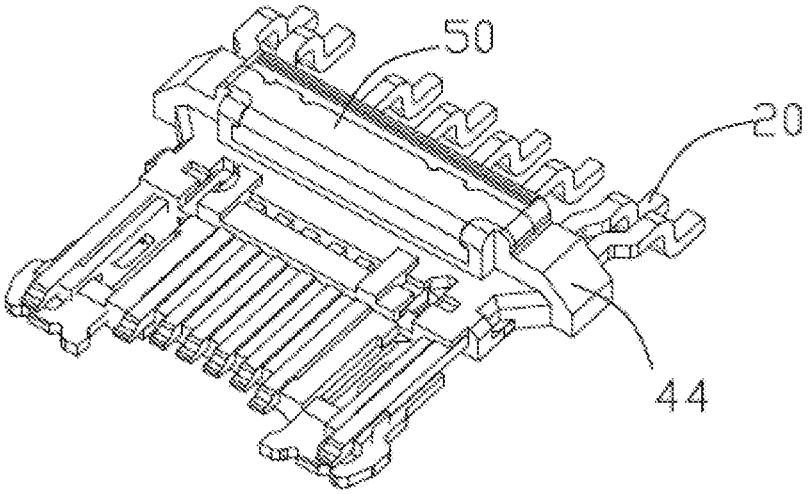
FIG. 7 is a combination diagram of a stopping member, a metal intermediate plate, a first terminal group, and a first plastic body of the waterproof USB socket according to Embodiment 1 of the present disclosure.
Figure 8:
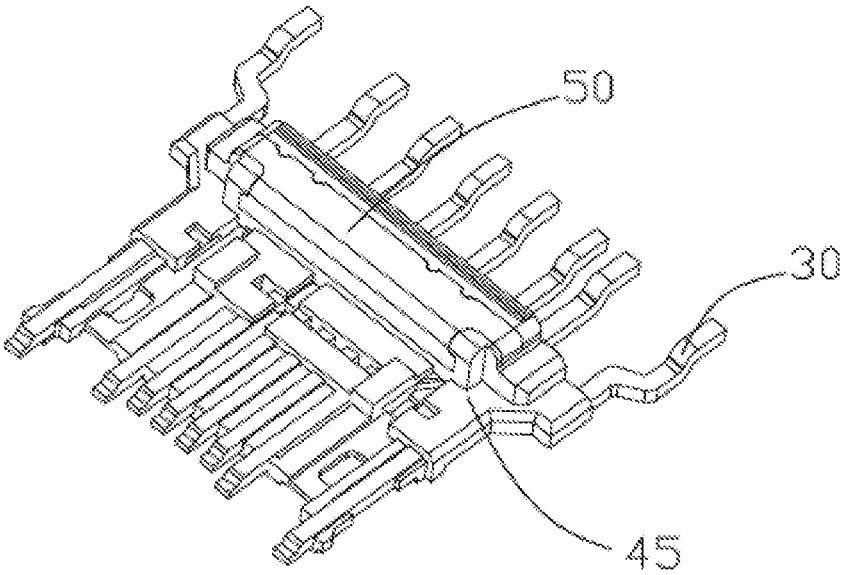
FIG. 8 is a combination diagram of a stopping member, a second terminal group, and a second plastic body of the waterproof USB socket according to Embodiment 1 of the present disclosure.
Figure 9:
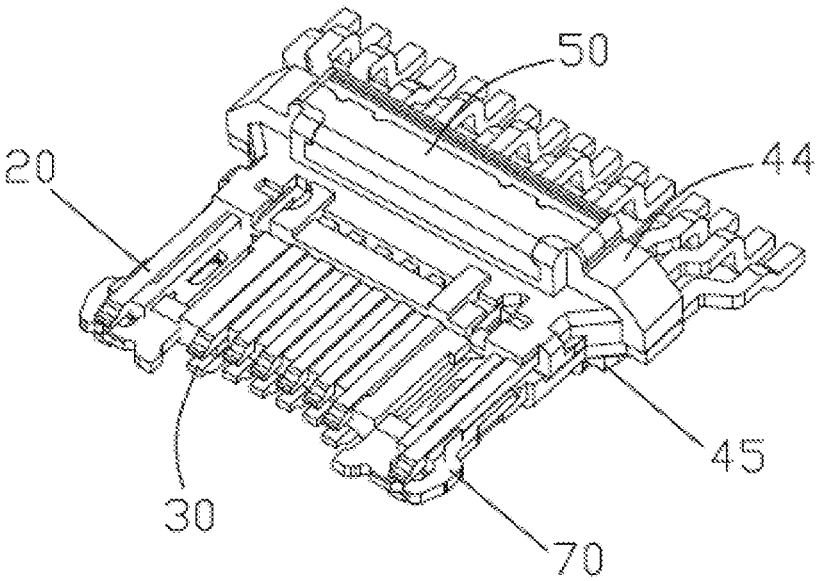
FIG. 9 is a perspective view of the first plastic body and the second plastic body of the waterproof USB socket that are stacked into one piece after being formed according to Embodiment 1 of the present disclosure.
Figure 10:
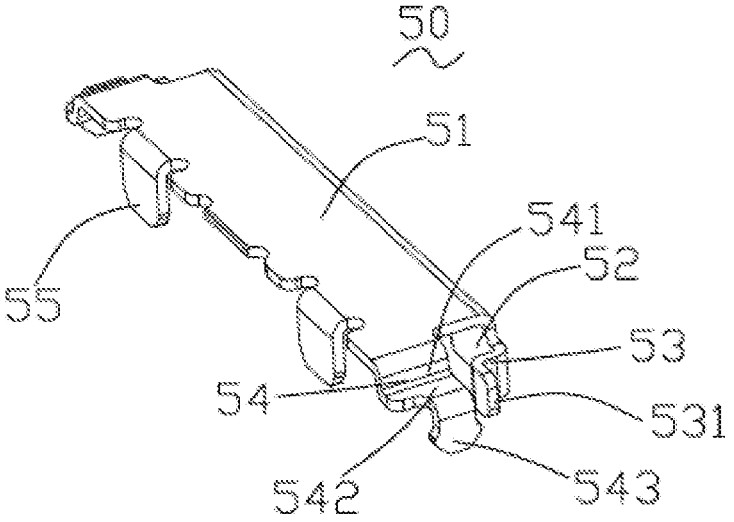
FIG. 10 is a perspective view of a stopping member of a waterproof USB socket according to Embodiment 2 of the present disclosure.
Figure 11:
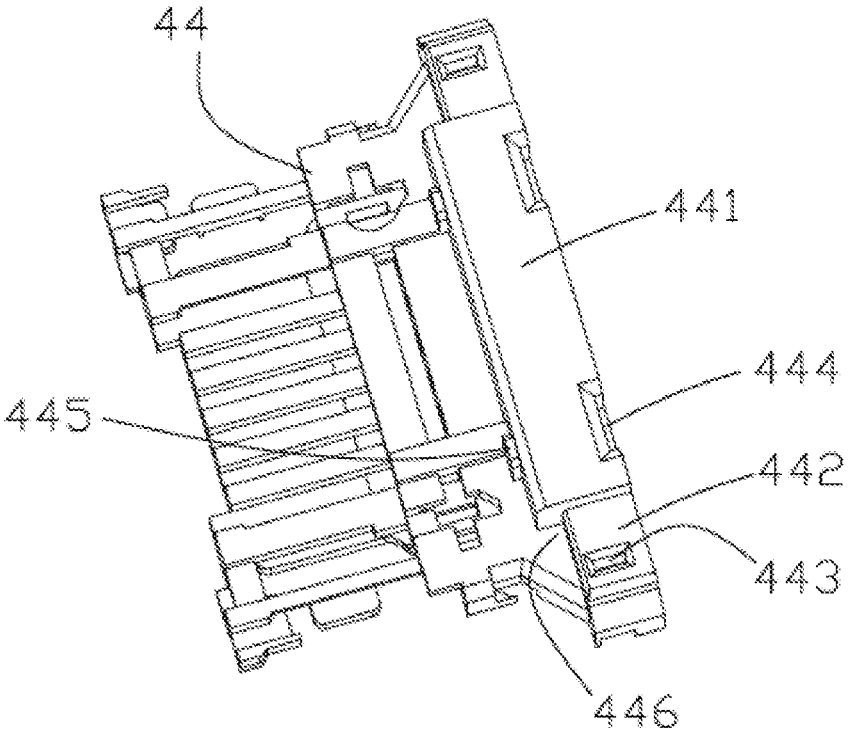
FIG. 11 is a perspective view of a first plastic body of the waterproof USB socket according to Embodiment 2 of the present disclosure.
Figure 12:
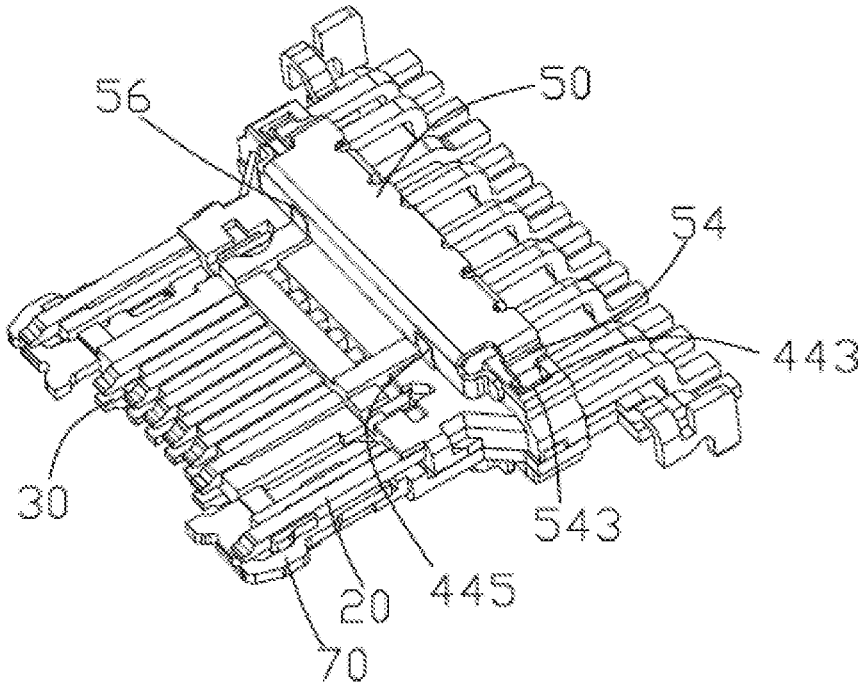
FIG. 12 is a perspective view of the waterproof USB socket according to Embodiment 2 of the present disclosure, in which the stopping member of the waterproof USB socket is assembled and fixed on the first and second plastic body.

With reference to FIG. 6 and FIG. 7, the first and second plastic bodies 44, 45 are each provided with a receiving groove 441 at a position corresponding to the base portion 42. A removed portion 442 is formed at each of two lateral sides of the receiving groove 441. The receiving groove 441 extends from the position corresponding to the base portion 42 to a front end. The stopping member 50 is integrated in the receiving groove 441. The second embedded portion 53 and the third embedded portion 55 are embedded in the first or second plastic body 44, 45. The horizontal portion 542 at a bottom of the first embedded portion 54 is embedded in the first or second plastic body 44, 45, and the vertical portion 541 of the first embedded portion 54 is exposed at a position of the removed portion 442.

When the first and second plastic bodies 44, 45 are stacked and then formed again, the vertical portion 541 is completely covered by and embedded in the third plastic body 46.

After the connector A is inserted into the inner metal shell 11, the spot-welding platform 51 of the stopping member 50 and the inner metal shell 11 are spot-welded into one piece by means of spot-welding. In this case, when a mating plug is inserted, the stopping portion 52 of the stopping member 50 is configured to resist a pressing force exerted by the mating plug and transfer the pressing force to the inner metal shell 11, and the inner metal shell 11 transfers the pressing force to the metal shells 12, 13. Therefore, it is unnecessary to punch the inner metal shell 11 to form a stopping member, and it is unnecessary to form a hole. Meanwhile, the inner metal shell 11 is manufactured by a drawing process, and there is no seam in the peripheral wall 111 of the inner metal shell 11.

Figure 4:
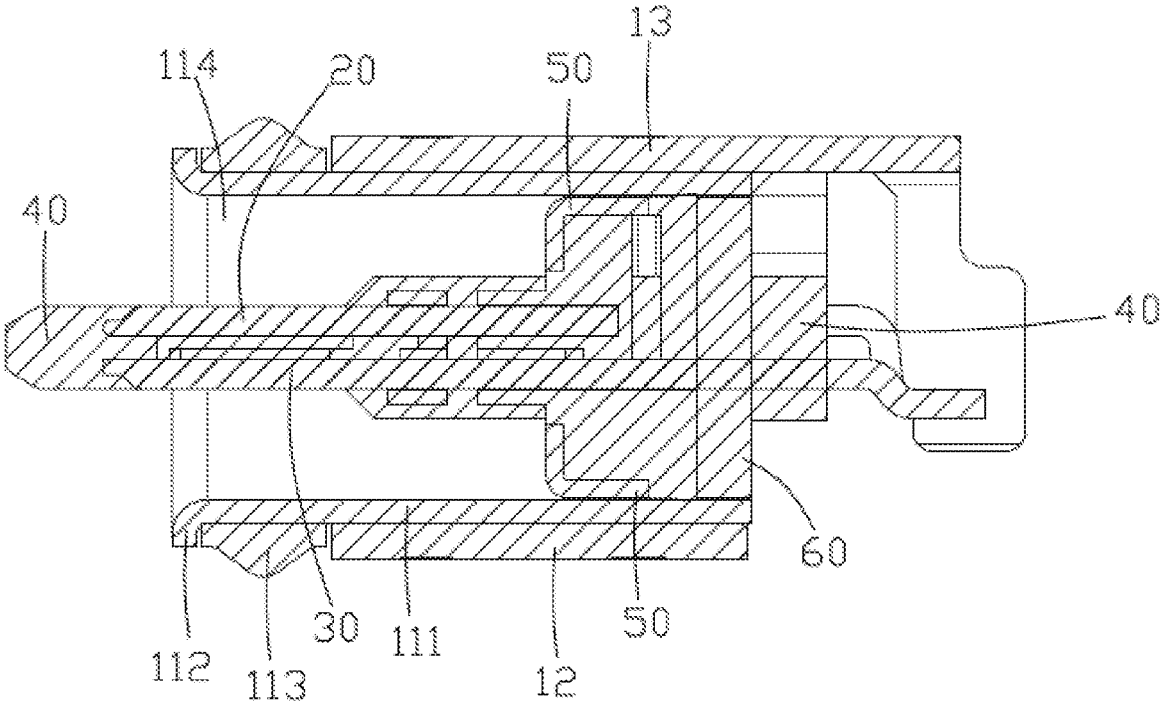
FIG. 4 is a cross-sectional view along a dotted line A-A shown in FIG. 1.
Figure 13:
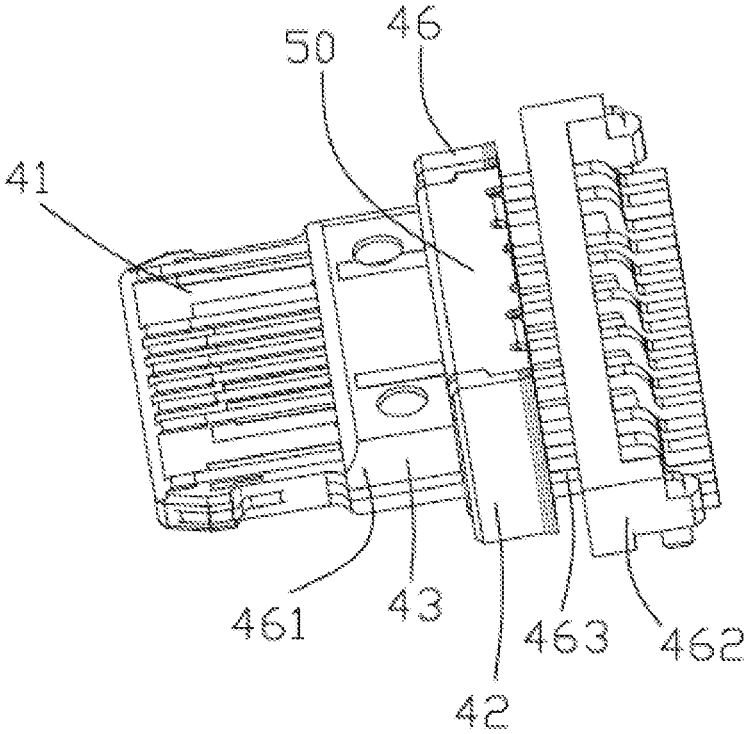
FIG. 13 is a perspective view of a third plastic body of the waterproof USB socket according to Embodiment 2 of the present disclosure, which the third plastic body integrates the first and second plastic body of the waterproof USB socket into one piece.

With reference to FIG. 4 and FIG. 13, the third plastic body 46 includes a front end 461 that integrates the first and second plastic bodies 44, 45 into one piece, and a rear end 462 that integrates the first and second terminal groups 20, 30 into one piece. The front end 461 and the rear end 462 are mutually independent and are not connected by plastic. Thus, a glue space 463 is formed between the front end 461 and the rear end 462, and the glue space 463 is filled with waterproof glue 60. The waterproof glue 60 tightly wraps the first and second terminal groups 20, 30, and is closely attached to an inner wall of the inner metal shell 11 to form a waterproof layer having a waterproofing function.

The waterproof USB socket of the present disclosure is manufacturing by a manufacturing method described as below:

Step S01: a first in-mold injection molding is performed on the first terminal group 20, the metal intermediate plate 70 and one stopping member 50 that are prepared and punched, to form the first plastic body 44; and a second in-mold injection molding is performed on the second terminal group 30 and the other stopping member 50 that are prepared and punched, to form the second plastic body 45;

Step S02: a third in-mold injection molding is performed on the first plastic body 44 and the second plastic body 45 that are stacked, to form the third plastic body 46. At this moment, the manufacturing of the connector A is completed;

Step S03: the connector A is inserted in the inner metal shell 11, and the inner metal shell 11 and the spot-welding platform 51 of the stopping member 50 are welded into one piece by means of spot-welding; and Step S04, the inner metal shell 11 is sandwiched by the outer metal shells 12, and the outer metal shells 12, 13 and the inner metal shell 11 are spot-welded into one piece.

An implementation of the waterproof USB socket in the present embodiment is illustrated in details by taking a USB3.1 Type C socket as an example. Meanwhile, implementation of this embodiment is not limited to the USB3.1 Type C socket and is also applicable to a general USB socket. A difference of the general USB socket is in that, the connector A merely includes one terminal group at one side, it is unnecessary to provide the metal intermediate plate, and the insulating body is formed by one-time injection molding. In an implementation process, the stopping member is embedded in the base portion of the insulating body during the one-time injection molding process, and then the stopping member and the inner metal shell are spot-welded into one piece.

Embodiment 2

Referring to FIG. 10 to FIG. 13, in the present embodiment, the first embedded portion 54 of the stopping member 50 further includes a hook 543 formed by extending from the horizontal portion 542 while being bent downward. The second embedded portion 53 further includes an engaging portion 531 formed by extending from an end of the second embedded portion 53 while being bent vertically. The stopping portion 52 of the stopping member 50 is further provided with a positioning notch 56.

The receiving groove 441 of the first and second plastic bodies 44, 45 at the position corresponding to the base portion 42 in Embodiment 1 is replaced with a receiving platform 441 in Embodiment 2. The removed portion 442 at an outer lateral side of the receiving platform 441 is provided with an engaging hole 443, and a rear end edge of the receiving platform 441 is provided with an engaging slot 444 to be inserted by the third embedded portion 55. A front end of the receiving platform 441 is provided a positioning block 445 matching the positioning notch 56 of the stopping member 50, and a front end of the removed part 442 is provided with a concession space 446 for receiving the second embedded portion 53. The stopping member 50 is inserted in the receiving platform 441, the hook 543 of the first embedded portion 54 of the stopping member 50 is engaged and fixed in the engaging hole 443. The second embedded portion 53 is received in the concession space 446, and the third embedded portion 55 is inserted in the engaging slot 444. The positioning notch 56 matches the positioning block 445 of the front end of the receiving platform 441.

Thee waterproof USB socket of Embodiment 2 of the present disclosure is manufactured by a manufacturing method described as below:

Step S01: a first in-mold injection molding is performed on the first terminal group 20 and the metal intermediate plate 70 that are prepared and punched, to form the first plastic body 44; and a second in-mold injection molding is performed on the second terminal group 30 that is prepared and punched, to form the second plastic body 45.

Step S02: the stopping member 50 that is prepared and punched is inserted into the receiving platform 441 of the first and second plastic bodies 44, 45, respectively, in an engaging manner described above, which is not be repeated herein;

Step S03: a third in-mold injection molding is performed on the first plastic body 44 and the second plastic body 45 that are stacked, to form the third plastic body 46, in which the third plastic body 46 fully fills the removed portions 442 and the concession space 446 of the first and second plastic bodies 44, 45 to tightly fix the stopping member 50 and the connector into one piece;

Step S04: the connector A is inserted into the inner metal shell 11, and the inner metal shell 11 and the spot-welding platform 51 of the stopping member 50 are welded into one piece by means of spot-welding; and Step S05: the inner metal shell 11 is sandwiched by the outer metal shells 12, 13, and the outer metal shells 12, 13 and the inner metal shell 11 are spot-welded into one piece.

It should be understood that the terms "comprise", "include" or any other variants indicate non-exclusive inclusions, such that a process, a method, a product, or an apparatus including a series of elements further include elements other than the series of elements, which are not explicitly listed, or further include elements that are inherent to such a process, method, product, or apparatus. Without any specific limitations, the process, method, product, or apparatus limited by "comprising" or "including" shall not exclude the presence of other unmentioned equivalent elements.

The above description is merely a part of embodiments of the present disclosure, instead of limiting the scope of the present disclosure. Those skilled in the art understand that the technical solutions of the above embodiments can be modified. Any modifications, equivalent substitutions, or improvements made without departing from the spirit and principle of the present disclosure shall fall within the protection scope defined by the claims.

What is claimed is:

1. A waterproof Universal Serial Bus (USB) socket, comprising a connector, a metal housing sleeved on a periphery of the connector, a waterproof glue filled in a tail portion of the connector, and a waterproof ring sleeved on a periphery of the metal housing, wherein the connector comprises a metal intermediate plate, a first terminal group and a second terminal group respectively provided at an upper side and a lower side of the metal intermediate plate, and an insulating body integrating the metal intermediate plate, the first terminal group and the second terminal group into one piece;

wherein the insulating body comprises a base portion, a step portion formed by extending forward from the base portion, and a docking portion formed by extending forward from the step portion;

wherein the metal housing comprises an inner metal shell having a seamless outer wall; and wherein a stopping member is integrally formed on the base portion of the insulating body, and the stopping member comprises a spot-welding platform, and a stopping portion formed at a front end of the base portion by bending and then extending downward from the spot-welding platform; and wherein the spot-welding platform of the stopping member and the inner metal shell are in contact and fixed into one piece by means of spot-welding.

2. The waterproof USB socket according to claim 1, wherein:

the insulating body comprises a first plastic body, a second plastic body and a third plastic body;

the first plastic body integrates the first terminal group, the metal intermediate plate and one stopping member into one piece;

the second plastic body integrates the second terminal group and another stopping member into one piece; and the third plastic body integrates the first plastic body and the second plastic body into one piece.

3. The waterproof USB socket according to claim 2, wherein the first plastic body and the second plastic body are each provided with a receiving groove at a position corresponding to the base portion, and two lateral sides of the receiving groove are removed to form removed portions; and wherein the receiving groove extends from the position corresponding to the base portion to the front end of the base portion.

4. The waterproof USB socket according to claim 3, wherein the stopping member further comprises first embedded portions formed by extending downward from two lateral sides of the spot-welding platform and then bending in parallel to the spot-welding platform, and each of the first embedded portions comprises a vertical portion and a horizontal portion.

5. The waterproof USB socket according to claim 4, wherein a third embedded portion is formed by extending downward from a longitudinal rear end of the spot-welding platform; and wherein second embedded portions are formed by extending from two lateral sides of the stopping portion towards the spot-welding platform.

6. The waterproof USB socket according to claim 5, wherein the stopping member is integrally formed in the receiving groove, and each of the second embedded portions and the third embedded portion is embedded in the first plastic body or the second plastic body; and wherein the horizontal portion at a bottom of each of the first embedded portions is embedded in the first plastic body or the second plastic body, and the vertical portion of each of the first embedded portions is exposed at a position of the removed portions.

7. The waterproof USB socket according to claim 6, wherein when the first plastic body and the second plastic body are stacked and then insert molding again, the removed portions are fully filled by the third plastic body, and the vertical portion is completely embedded in the third plastic body.

8. The waterproof USB socket according to claim 1, wherein the metal housing further comprises a first metal shell and a second metal shell that sandwich the inner metal shell from an upper side and lower side, and wherein the first metal shell and the second metal shell are fixed to the inner metal shell by means of spot-welding.

9. The waterproof USB socket according to claim 8, wherein the first metal shell and the second metal shell are each provided with ear portions extending at lateral sides, and a fixing hole is opened at a middle position of each of the ear portions.

10. A manufacturing method of the waterproof USB socket according to claim 9, comprising:

performing a first in-mold injection molding on the first terminal group, the metal intermediate plate and one stopping member that are prepared and punched, to form the first plastic body;

performing a second in-mold injection molding on the second terminal group and the other stopping member that are prepared and punched, to form the second plastic body;

performing a third in-mold injection molding on the first plastic body and the second plastic body that are stacked, to form the third plastic body and complete a manufacturing of the connector;

inserting the connector into the inner metal shell, and welding the inner metal shell and the spot-welding platform of the stopping member into one piece by means of spot-welding; and sandwiching the inner metal shell by the first metal shell and the second metal shell, and spot-welding the inner metal shell, the first metal shell and the second metal shell into one piece.

11. A waterproof Universal Serial Bus (USB) socket, comprising a connector, a metal housing sleeved on a periphery of the connector, a waterproof glue filled in a tail portion of the connector, and a waterproof ring sleeved on a periphery of the metal housing, wherein the connector comprises a metal intermediate plate, a first terminal group and a second terminal group respectively provided at an upper side and a lower side of the metal intermediate plate, and an insulating body integrating the metal intermediate plate, the first terminal group and the second terminal group into one piece;

wherein the insulating body comprises a base portion, a step portion formed by extending forward from the base portion, and a docking portion formed by extending forward from the step portion;

wherein the metal housing comprises an inner metal shell having a seamless outer wall;

wherein a stopping member is inserted in the base portion of the insulating body, and the stopping member comprises a spot-welding platform, and a stopping portion formed at front end of the base portion by bending and then extending downward from the spot-welding platform; and wherein the spot-welding platform of the stopping member and the inner metal shell are in contact and fixed into one piece by means of spot-welding.

12. The waterproof USB socket according to claim 11, wherein the insulating body comprises a first plastic body, a second plastic body and a third plastic body;

wherein the first plastic body integrates the first terminal group and the metal intermediate plate into one piece; and wherein the second plastic body integrates the second terminal group into one piece.

13. The waterproof USB socket according to claim 12, wherein the first plastic body and the second plastic body are each provided with a receiving platform at a position corresponding to the base portion, and two lateral sides of the receiving platform are removed to form removed portions;

wherein each of the removed portions is provided with an engaging hole; and wherein the stopping member further comprises first embedded portions formed by extending downward from two lateral sides of the spot-welding platform and then bending in parallel to the spot-welding platform, and each of the first embedded portions comprises a vertical portion, a horizontal portion, and a hook inserted in the engaging hole.

14. The waterproof USB socket according to claim 13, wherein a front end of each of the removed portions is provided with a concession space, and second embedded portions are formed by extending from two lateral sides of the stopping portion while being bent towards the spot-welding platform, and are received in the concession space; and wherein each of the second embedded portions further comprises an engaging portion formed by extending from an end of the second embedded portion while being bent vertically.

15. The waterproof USB socket according to claim 12, wherein a rear end edge of the receiving platform is provided with an engaging slot, and a front end of the receiving platform is provided with a positioning block;

wherein a third embedded portion is formed by extending from a longitudinal rear end of the spot-welding platform while being bent downward and is inserted into the engaging slot; and wherein the stopping portion of the stopping member is further provided with a positioning notch matching the positioning block.

16. The waterproof USB socket according to claim 14, wherein the stopping member is inserted in the receiving platform, the hook is inserted in the engaging hole, and the vertical portion and the horizontal portion are exposed at a position of the removed portions.

17. The waterproof USB socket according to claim 16, wherein the third plastic body integrates the first plastic body, the second plastic body and two stopping members into one piece;

wherein the third plastic body fully fills the removed portions and the concession space in such a manner that the first embedded portions and the second embedded portions of the stopping member are completely embedded and fixed in the third plastic body.

18. The waterproof USB socket according to claim 11, wherein the metal housing further comprises a first metal shell and a second metal shell that sandwich the inner metal shell, and the first metal shell and the second metal shell are fixed to the inner metal shell by means of spot-welding.

19. The waterproof USB socket according to claim 18, wherein the first metal shell and the second metal shell are each provided with ear portions extending at lateral sides, and a fixing hole is opened at a middle position of each of the ear portions.

20. A manufacturing method of the waterproof USB socket according to claim 19, comprising:

performing a first in-mold injection molding on the first terminal group and the metal intermediate plate that are prepared and punched, to form the first plastic body;

performing a second in-mold injection molding on the second terminal group that is prepared and punched, to form the second plastic body;

inserting the stopping member that is prepared and punched into the receiving platform of the first plastic body and the second plastic body, respectively;

performing a third in-mold injection molding on the first plastic body and the second plastic body that are stacked, to form the third plastic body, wherein the third plastic body fully fills the removed portions and the concession space of the first plastic body and the second plastic body to tightly fix the stopping member and the connector into one piece;

inserting the connector into the inner metal shell, and welding the inner metal shell and the spot-welding platform of the stopping member into one piece by means of spot-welding; and sandwiching the inner metal shell by outer metal shells, and spot-welding the inner metal shell and the outer metal shells into one piece.

* * * * *